United States Patent [19]

Howard

[11] Patent Number: 4,666,213

[45] Date of Patent: May 19, 1987

[54] ROCK BREAKER TOOL

[76] Inventor: Artis N. Howard, P.O. Box 526, Evadale, Tex. 77615

[21] Appl. No.: 780,945

[22] Filed: Sep. 27, 1985

[51] Int. Cl.[4] ..... E02F 5/16; A01B 35/00

[52] U.S. Cl. ..... 299/37; 173/132; 37/DIG. 8; 172/40

[58] Field of Search ..... 299/37, 38, 14, 69, 299/70; 173/129, 130, 132; 37/DIG. 18; 172/40

[56] References Cited

U.S. PATENT DOCUMENTS

| | | | |
|---|---|---|---|
| 2,499,620 | 3/1950 | Alderman | 37/DIG. 18 X |
| 3,386,517 | 6/1968 | Kelley | 172/40 |
| 3,520,573 | 7/1970 | Neinast | 299/69 |
| 3,749,446 | 7/1973 | Doty | 299/37 |
| 3,762,481 | 10/1973 | Allen et al. | 172/40 |
| 3,770,322 | 11/1973 | Cobb et al. | 299/14 X |
| 3,778,111 | 12/1973 | Ciofani | 299/37 X |
| 4,140,348 | 2/1979 | Strada | 299/70 |
| 4,164,982 | 8/1979 | Draney | 172/40 |

FOREIGN PATENT DOCUMENTS

| | | | |
|---|---|---|---|
| 939673 | 6/1982 | U.S.S.R. | 172/40 |

*Primary Examiner*—James A. Leppink
*Assistant Examiner*—Michael A. Goodwin
*Attorney, Agent, or Firm*—Nies, Webner, Kurz & Bergert

[57] ABSTRACT

A rock breaker tool for use with earth working apparatus is disclosed. The tool includes a ripper tooth employed with a hammer and anvil arrangement located above the upper portion of the tooth. The present invention is so constructed as to minimize the transfer of force directly from the hammer to the hydraulic cylinders of the earth working apparatus. The invention may be employed with various types of earth working apparatus, including backhoes, bulldozers and ripper buckets.

27 Claims, 12 Drawing Figures

ROCK BREAKER TOOL

BACKGROUND AND SUMMARY OF THE INVENTION

The present invention relates to a rock breaker tool for use with earth working apparatus. More particularly, the present invention relates to a rock breaking tool which employs a ripper tooth along with a hammer and anvil for use with excavating equipment such as a backhoe. The invention provides a tool which is energy efficient and particularly well suited for use in breaking rocks such as in the construction of roadbeds and for other purposes.

Previous devices employing a ripper tooth have been known in the prior art for use in breaking rock and for similar purposes. Apparatus in which an impact member such as a hammer is associated with a ripper tooth for use in earth working operations is described, for example, in U.S. Pat. No. 4,003,603 to Stemler et al.

By the present invention, there is provided an improved rock breaking tool which utilizes a ripper tooth and a hammer and anvil arrangement located above the upper portion of the tooth. The present tool employs a hammer, preferably operated by air or steam, which can deliver a blow of about 4000 to 6000 lbs. at a rate of about 80 to 250 blows per minute. In the tool of the present invention, a constant force is applied against the ripper tooth during operation. The use of a constant force held or applied against the ripper tooth while the hammer applies force to the tooth through the anvil results in improved operation with less energy being required and with reduced vibration during operation. The present invention has been found to be fully operable in water depths up to eighty feet. The apparatus of the present invention also results in a minimum amount of heat being produced during operation. In addition, ripping operations have been reduced from days to a matter of hours for a comparable job.

In one embodiment of the invention, the rock breaker tool is employed with a backhoe. In a second embodiment, the rock breaker tool is employed with a bulldozer. The rock breaker may also be employed in a third embodiment in conjunction with a ripper bucket.

DESCRIPTION OF THE PREFERRED EMBODIMENTS

Figure 1:
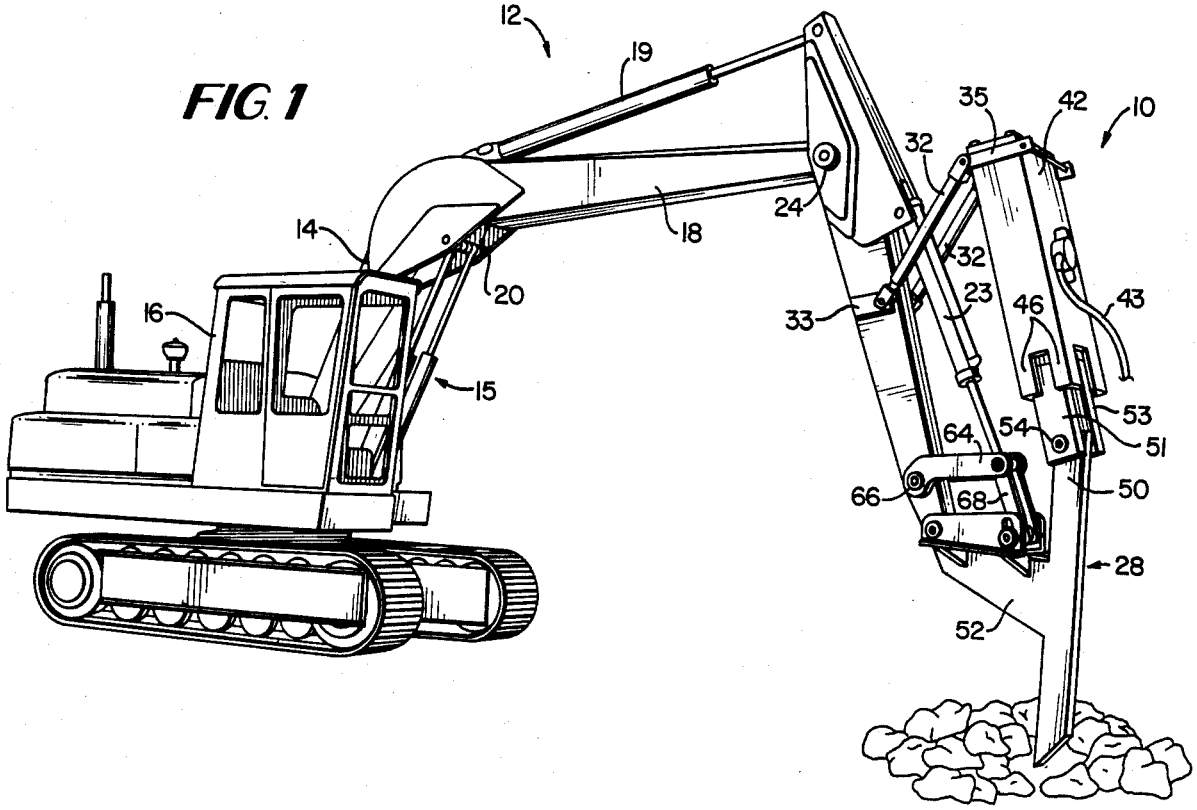
FIG. 1 is a perspective view of the rock breaker tool of the present invention as installed on a backhoe.
Figure 6:
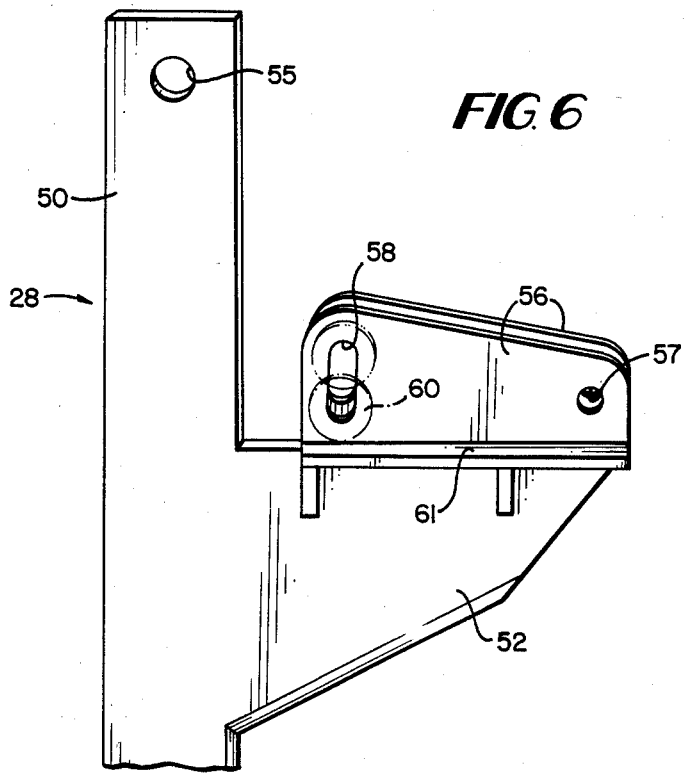
FIG. 6 is an enlarged rear elevation of a portion of the ripper tooth employed in the rock breaker tool of FIG. 1.

In the embodiment of the invention as shown in FIGS. 1 through 7, there is provided a rock breaker tool 10 for use with a backhoe or other excavating equipment indicated generally at 12 in FIG. 1. The backhoe 12 has a boom or hoist 14 that is attached to a tractor shown at 16. The manner of attaching the boom 14 to the tractor 16 may be of any suitable type known in the art. A pair of boom cylinders 15 is also provided.

The backhoe 12 has a crowd 18 that is pivoted to the boom at 20. A curl 22 is pivoted to the crowd at 24. A crowd cylinder 19 and curl cylinder 23 are provided in a conventional manner. The cylinders 15, 19 and 23 are hydraulic cylinders of conventional type.

Figure 7:
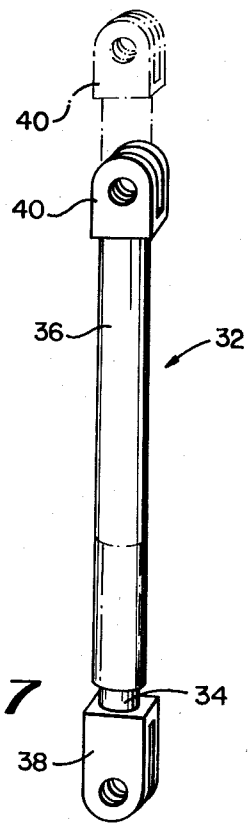
FIG. 7 is a perspective view of the hammer brace arms employed in the rock breaker tool of FIG. 1.
Figure 2:
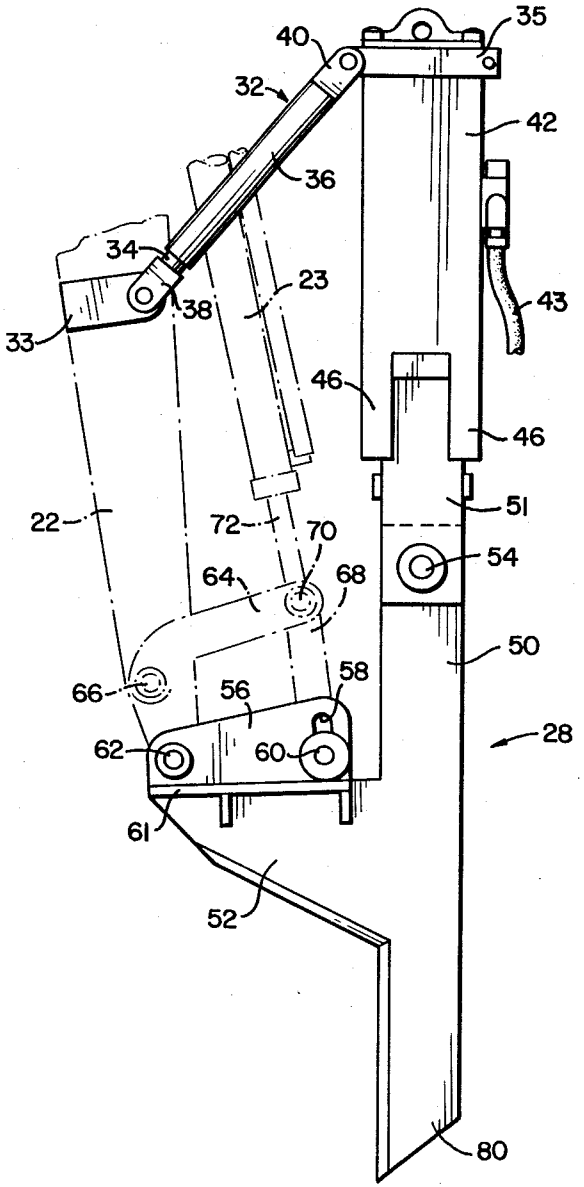
FIG. 2 shows a front elevation of the rock breaker tool of FIG. 1.
Figure 5:
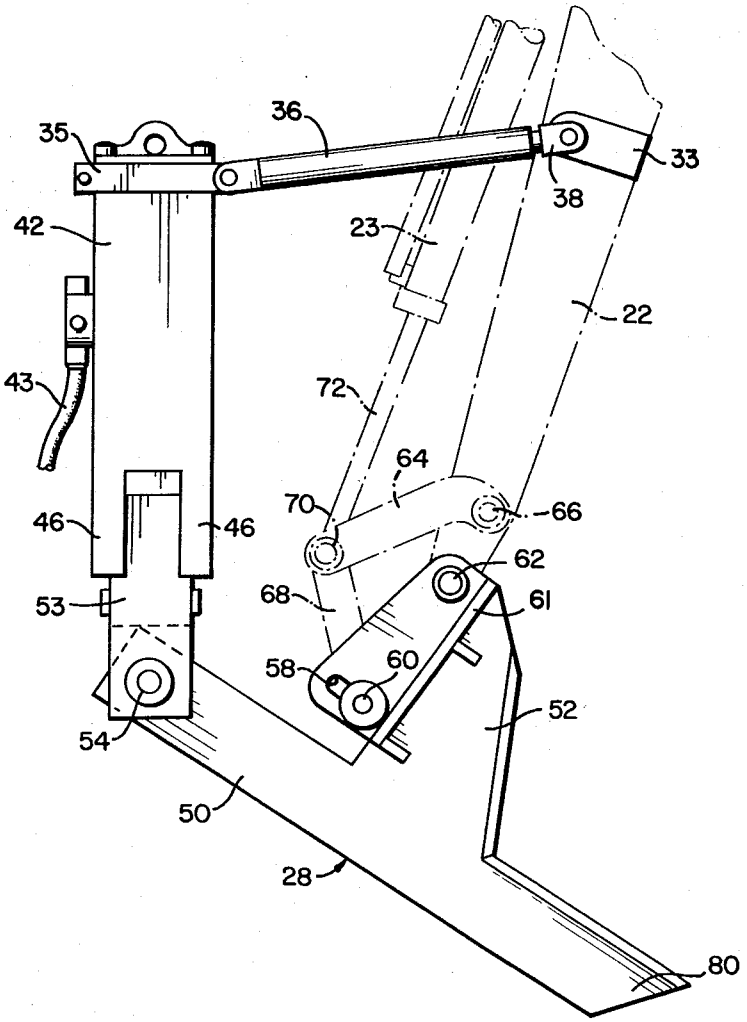
FIG. 5 is a rear elevation, similar to FIG. 4, but with the ripper tooth inclined at a different angle relative to the hammer.
Figure 4:
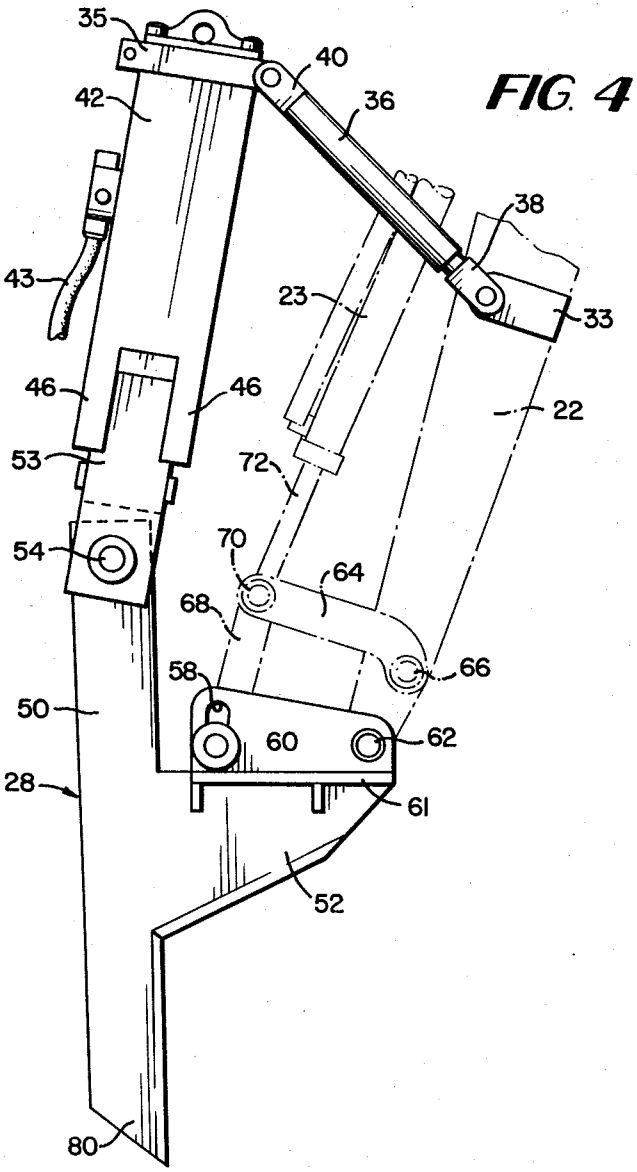
FIG. 4 is a rear elevation of the rock breaker tool of FIG. 2, showing the ripper tooth at an angle relative to the hammer.

At the upper end of the curl 22 there are pivotally attached a pair of telescoping hammer brace arms 32. Each brace arm 32 includes a piston 34 and cylinder 36 portion, as shown in FIG. 7, along with connecting portions 38, 40 to allow the ends of each brace arm 32 to be secured to the curl 22 and the hammer 42, respectively, by means such as brackets 33, 35 as shown in FIG. 2. Suitable conventional means (not shown) such as a pin is provided for locking the piston 34 and cylinder 36 in the desired relative positions after the proper length of each arm 32 has been determined for the particular excavator with which the rock breaker tool 10 is to be employed.

The hammer 42 employed in the present invention may be any suitable hammer which will deliver the necessary energy to the ripper tooth 28. In one embodiment, the hammer 42 is a fluid-valve hammer provided with angle-iron guides or legs 46, with a guide 46 being provided at each of the four corners of the lower end of the hammer 42. A particular hammer and anvil set which has been employed is a MKT fluid valve hammer and associated angle-iron guides sold by Geotechnical Systems of Dover, N.J. The hammer 42 is operated by suitable compressed air or steam means through hose 43.

Figure 3:
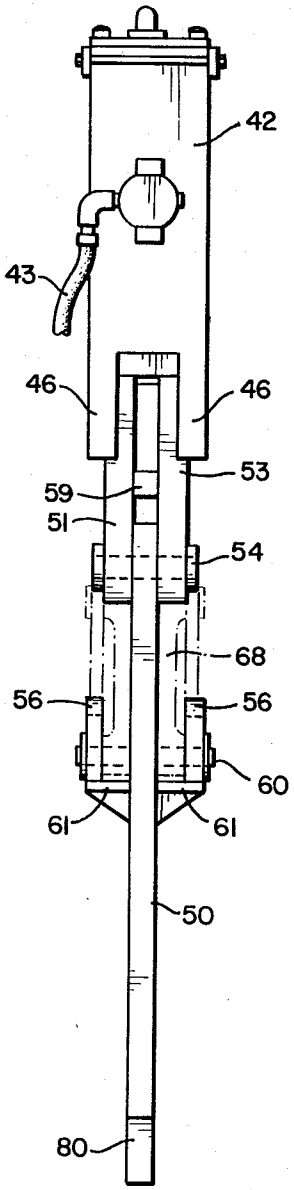
FIG. 3 shows a side elevation from the right side of the rock breaker tool of FIG. 2.

The anvil is in the form of a pair of parallel arms 51, 53 having inner brace member 59, as shown in detail in FIG. 3. The arms 51, 53 are received at their upper ends by the angle-iron guides 46. The top surfaces of the arms 51, 53 are positioned adjacent the lower end of the hammer 42. In the embodiment as shown, the anvil is not fixed to the hammer. As an alternative, a hammer could be employed which would be mounted so as to be fixed or tied solid to the anvil. In such a construction, the guide legs 46 would be fixed to the anvil.

Figure 8:
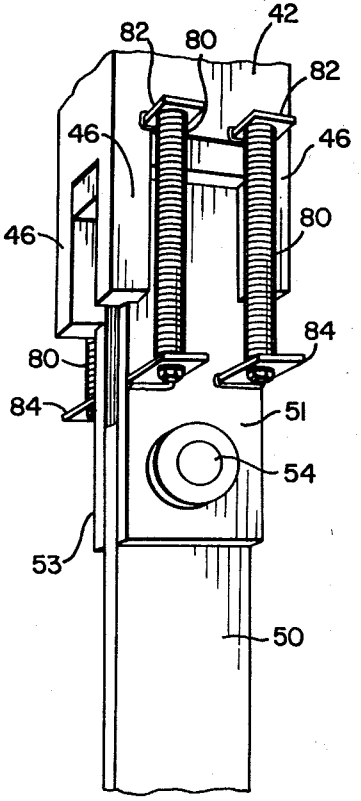
FIG. 8 is a perspective view of an alternative embodiment of the hammer and anvil employed with the rock breaker tool of FIG. 1.

In an alternative embodiment, as shown in FIG. 8, a plurality of stabilizer spring members 80 are employed to stabilize the relationship between the anvil and the hammer. These springs 80 are in a neutral condition of tension as installed, with the upper end of each spring 80 being connected to a bracket 82 mounted adjacent the base of the hammer 42, and with the lower end of each spring 80 being connected to a bracket 84 mounted on one of the arms 51, 53 of the anvil just below the guides 46. In one embodiment, four springs 80 were employed, with one spring 80 adjacent each of the guides 46.

Figure 12:
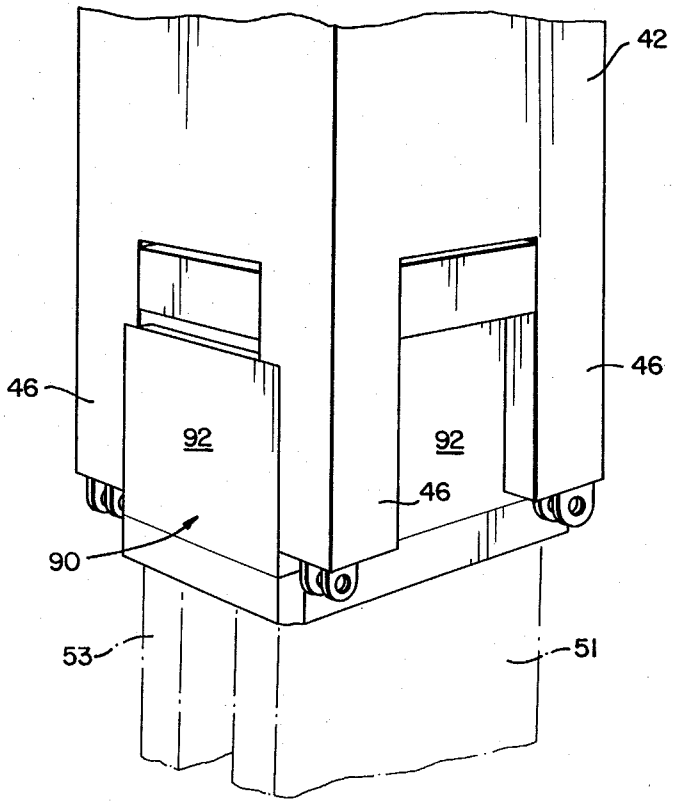
FIG. 12. is a perspective view of an alternative embodiment in which the hammer is provided with an anvil guide box.

In a further embodiment, as shown in FIG. 12, an anvil guide box 90 is secured to the angle-iron guides 46 with the upper end of the guide box 90 being positioned just below the bottom of the hammer 42. The guide box 90 is a four-sided structure with four exterior planar faces 92 and serves as a guide to maintain the upper ends of the arms 51, 53 of the anvil in proper position relative to the hammer 42.

It is within the scope of the present invention to utilize the stabilizer springs 80 in combination with the anvil guide box 90. In such an embodiment, the upper ends of the springs 80 would be attached to the guide box 90 and the lower ends of the springs 80 would be attached to the arms 51, 53 of the anvil .

In the embodiment as shown in FIGS. 1 through 6, the ripper tooth 28 of the present invention is in the form of an elongated shank portion 50 with a reinforcing arm portion 52 extending generally outwardly and upwardly from the point of attachment to the shank portion 50. The upper end of the shank 50 is pivotally attached through hole 55 by pivot pin 54 to the parallel arms 51, 53 of the anvil located on either side of the upper end of the shank 50. The upper ends of the arms 51, 53 are retained within the angle-iron guides 46 as previously discussed.

The reinforcing arm 52 terminates at its upper end in a bifurcated portion which provides a pair of parallel vertical hinge plates 56 which serve as the point of attachment of the ripper tooth 28 to the curl 22 and cylinder 23. As shown in FIGS. 2 and 3, the hinge plates 56 are mounted on base plates 61 and are at a level slightly above that of the mid-portion of the length of the shank 50.

Each hinge plate 56 has a vertical slot 58 adjacent the inner end nearest to the shank 50 for receiving a horizontal hinge pin 60. Adjacent the outer end, each hinge plate 56 is connected to the curl 22 by horizontal hinge pin 62 which extends through a hole 57 in each plate 56.

A pair of support arms 64, one on each side of the lower end of the curl 22, are pivotally connected to the curl 22 by pin 66. The support arms 64 are pivotally connected at their opposite ends to a connector bar 68 by means of pin 70 which passes through a bore in the top portion of connector bar 68. The piston 72 which operates in conjunction with cylinder 23 is provided with an enlarged lower end portion having a bore therein which receives the pin 70. Thus the piston 72 is pivotally connected to the connector bar 68. The connector bar 68 has a horizontal bore in the lower end portion which receives pin 60.

The lower end of the ripper tooth terminates in an angled lower end portion 80 for the shank 50 and with the upwardly angled, lower edge surface of the reinforcing arm 52 and the adjacent vertical surface of the shank 50 being beveled to assist in penetration of the ripper tooth during ripping operations. A guard and tip of conventional configuration (not shown) are connected by pins to the lower end of the shank.

In one embodiment, the ripper tooth 28 was constructed of 3 inch steel with the arms 51, 53 of the anvil also being of 3 inch steel. In this embodiment, the vertical slot 58 in each hinge plate 56 was about 7 inches in length and the diameter of the pin 60 was about 3 inches.

In the operation of the rock breaker tool 10 of the present invention as shown in FIGS. 1 through 7, the vertical slots 58 in hinge plates 56 act as a safety to prevent the hammer 42 from transmitting energy directly against the cylinder 23. When the ripper tooth 28 is picked up during rock breaking operations, the pin 60 will move to the top of the slot 58.

Figure 11:
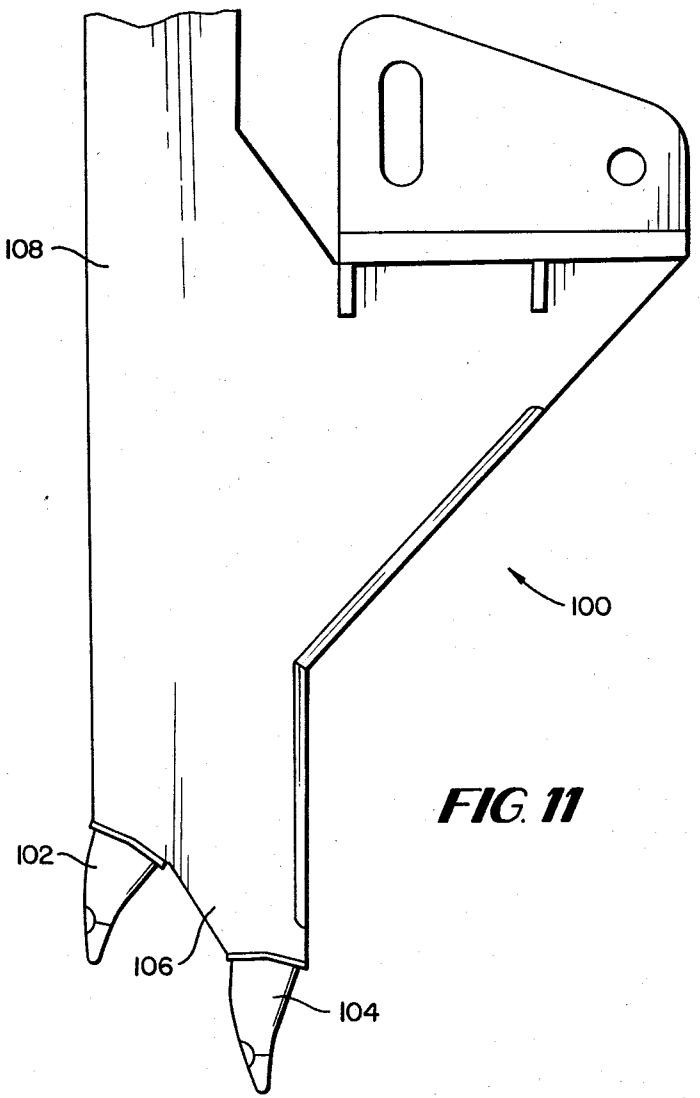
FIG. 11 is an elevation view of an alternative embodiment of the ripper tooth of the present invention.

In the embodiment as shown in FIG. 11, the ripper tooth 100 is provided with a pair of tips 102, 104 extending downwardly from the lower end 106 of the shank 108. The lower end 106 is angled upwardly away from the operator as in the case of the previous embodiment. The embodiment of FIG. 11 has been found to be particularly advantageous in situations in which the shank 108 is operating at angles of greater than 20 to 25 degrees with the lower end canted toward the operator. In such situations, the configuration of FIG. 11 helps to avoid hammering on the back of the shank 108 and allows the second or upper tooth 102 to start digging in.

The tips 102, 104 are of solid construction and fixed to the shank 108 by pins in a conventional manner. The lower tip 104 is angled in a generally downwardly direction while the upper tip 102 may be angled downwardly and outwardly at an angle such as about 20 to 30 degrees relative to the vertical axis of the tooth 100.

It is within the scope of the present invention for the ripper tooth 100 to be provided with more than two tips, with such plurality of tips being fixed to the lower end portion of the tooth. In such an embodiment, the lower end of the tooth may be angled upwardly as shown in FIG. 11 or, alternatively, may be provided as a downwardly convex surface for attachment of the tips at intervals along such surface.

Figure 9:
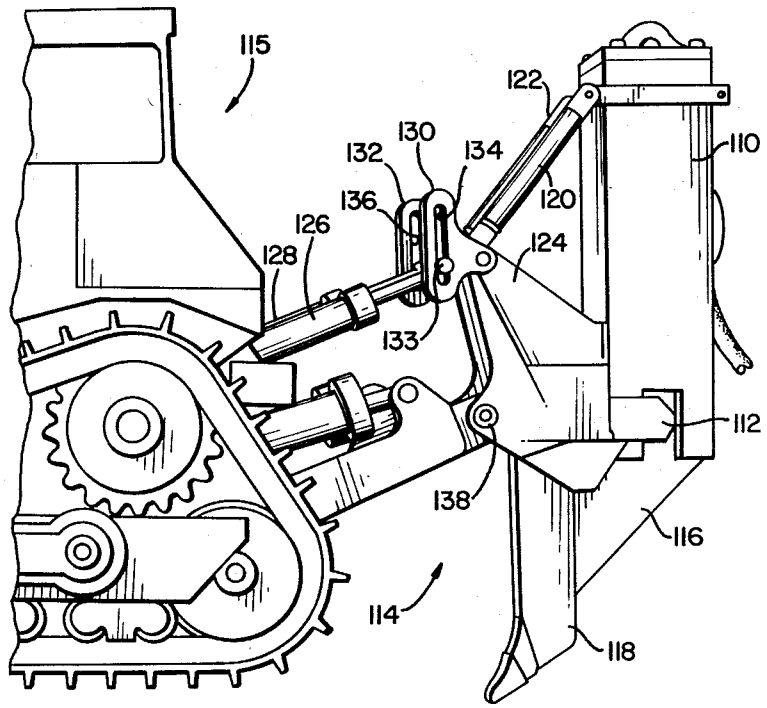
FIG. 9 is a front elevation of a second embodiment of the rock breaker tool of the present invention.

In FIG. 9 there is shown an embodiment in which the rock breaker tool of the present invention is employed with a bulldozer. In this embodiment, the hammer 110 is mounted in a vertical position in an anvil box 112 which in turn is mounted on the back side of the ripper portion 114 of the bulldozer 115. A gusset 116 in planar form is fixed to the bottom of the anvil box 112 by means such as welding, to assist in transferring the force of the hammer blows more directly to the point of the ripper tooth 118. In this regard, the gusset 116 is not fixed to the tooth 118 itself although the gusset 116 should be positioned closely adjacent and contiguous with the side surface of the tooth 118. In this manner, the tooth 118 can still be maneuvered up and down as the operator controls the tooth 118.

At the upper end of the hammer 110, a pair of brace arms 120, 122 are mounted one on each side of the hammer 110 by suitable means such as pad eyes and pins. The lower ends of the brace arms 120, 122 are mounted on the upper frame 124 of the ripper 114 by means such as pad eyes and pins.

The upper cylinders 126, 128 of the bulldozer 115 which assist in controlling operation of the ripper 114 are mounted to the upper frame 124 by means of a pair of cylinder adapters 130, 132 which are mounted by pins in the locations in which the cylinders would otherwise be pinned to the ripper frame 124. Each cylinder adaptor 130, 132 is provided with a vertical slot 134, 136 which receives the piston of a respective cylinder 126, 128. In this regard, each piston is provided with a pin 133 at the end thereof which is mounted in the respective slot so as to be slideable up and down within the slot. In this manner, the tooth 118 is thus hinged on pivot pin 138 and transfer of force from the hammer 110 directly to the cylinders 126, 128 is substantially reduced or prevented. In one embodiment, the slots 134, 136 were of a length of about 1 foot and the pins 133 were of a diameter of about 2 inches.

Figure 10:
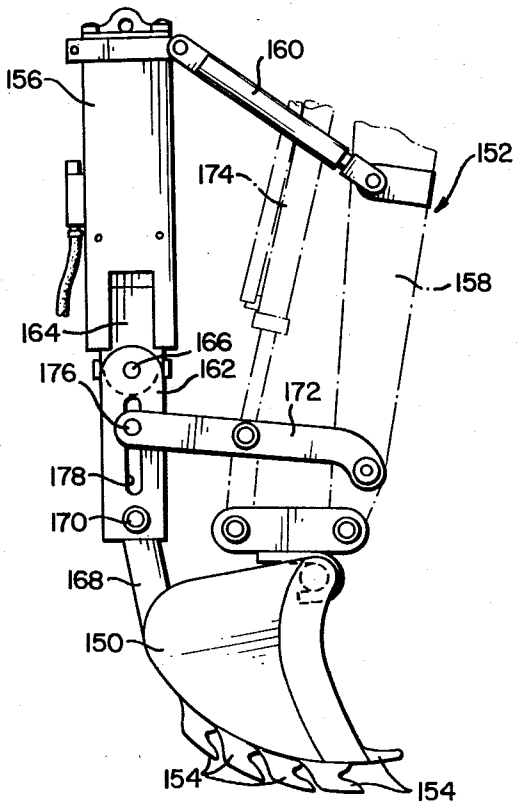
FIG. 10 is a front elevation of a third embodiment of the rock breaker tool of the present invention.

In FIG. 10 there is shown an embodiment in which the rock breaker tool of the present invention is employed in conjunction with a ripper bucket. In this embodiment, the invention is employed with a bucket 150 pivotally mounted in a conventional manner on a backhoe 152. The bucket 150 preferably has one or more ripper teeth 154 positioned on the exterior lower surface and lower lip.

The hammer 156 is attached to the curl 158 of the hoe by brace arms 160 and pins in a manner similar to the embodiment of FIG. 2. The anvil is in the form of a bar 162 which is pivotally connected to the base of the hammer 156 by means such as a pad eye 164 and pin 166. At the lower end, the bar 162 is pivotally secured to the bucket 150 by a pad eye 168 and pin 170, with the pad eye 168 being fixed to the back side of the bucket 150 and extending upwardly therefrom so as to serve effectively to transfer force from the hammer 156 to the bucket 150.

A pair of anvil guide arms 172 are attached to the curl 158 and cylinder 174 with pins and extend on either side of the anvil 162 to be mounted by means of a pin 176 in a vertical slot 178 in the anvil 162. Thus the arms 172 replace the manufacturer's arms such as shown in FIG. 2. In one embodiment, the anvil 162 had a length of about 4 to 5 feet, with a width of about 8 inches and a thickness of about 3 inches. The slot 178 was about 1 foot in length with a width of about 2 inches and the diameter of the pin 176 was about 2 inches. As the pin 176 is free to move up and down in the slot 178 during operation of the bucket 150, the transfer of the force of the hammer 156 directly to the cylinder 174 is substantially reduced or prevented.

In the various embodiments as discussed herein, it is seen that a slot and pin configuration is employed in an attempt to reduce or prevent the transfer of force from the hammer directly to the cylinder or cylinders of the excavating mechanism. Generally the slot should be of a length at least 2 to 3 times the diameter of the associated pin.

The present invention provides a versatile tool which is well suited for use with various types of excavating equipment. The present rock breaking tool is especially designed and constructed to accomodate a wide range of needs in the excavating industry.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for use with earth working apparatus, comprising:

hammer means; anvil means positioned adjacent the lower end of said hammer means so as to be acted upon by said hammer means during operation thereof; and a ripper tooth pivotally attached to said anvil means, said ripper tooth having pivot means for attachment of said ripper tooth to said earth working apparatus, said pivot means including a slot and a pin mounted in said slot, said slot having a length greater than the diameter of said pin to allow said pin to move freely back and forth in said slot.

2. The apparatus of claim 1, further including angle iron guides attached to said hammer means for use in retaining said anvil means.

3. The apparatus of claim 1 further including stabilizer spring means connecting said hammer means and anvil means.

4. The apparatus of claim 1 further including an anvil box attached to the lower end of said hammer for retaining said anvil means.

5. The apparatus of claim 1 wherein the length of said slot is at least 2 times the diameter of said pin.

6. The apparatus of claim 1 further including adjustable means for mounting said hammer means to said earth working apparatus.

7. The apparatus of claim 1 wherein said anvil means includes a pair of parallel arms.

8. The apparatus of claim 1 wherein said ripper tooth is provided with a plurality of tips on the lower end thereof.

9. The apparatus of claim 8 wherein said ripper tooth has a longitudinal axis and wherein one of said tips extends downwardly and outwardly at an angle of about 20 to 30 degrees relative to said longitudinal axis.

10. A ripper tooth for use with earth working apparatus in crushing rock and the like, comprising:

an elongated shank portion having upper and lower ends; a reinforcing arm portion, said arm portion extending outwardly from the shank portion; first pivot means for attaching the upper end of said shank to a first member of said earth working apparatus; and second pivot means for attaching said arm portion to a second member of said earth working apparatus, said second pivot means including a slot extending substantially parallel to the longitudinal axis of said shank and a pin mounted in said slot, said slot having a length greater than the diameter of said pin to allow said pin to move freely back and forth in said slot.

11. The ripper tooth of claim 10 wherein said first member of said earth working apparatus includes a hammer and anvil means.

12. The ripper tooth of claim 10 wherein said second member of said earth working apparatus includes a hydraulic piston and cylinder.

13. The ripper tooth of claim 10 wherein said arm portion is mounted at approximately the mid-portion of the length of said shank.

14. The ripper tooth of claim 10 wherein the lower end of said shank portion is angled upwardly in a direction away from said arm portion.

15. The ripper tooth of claim 10 wherein the length of said slot is at least 2 times the diameter of said pin.

16. The ripper tooth of claim 10 wherein said arm portion includes a pair of parallel hinge plates, each hinge plate having a slot extending substantially parallel to the longitudinal axis of said shank.

17. The ripper tooth of claim 10 wherein a plurality of tips are provided on the lower end of said shank.

18. The ripper tooth of claim 17 wherein one of said tips extends downwardly and outwardly at an angle of about 20 to 30 degrees relative to the longitudinal axis of said shank.

19. Apparatus for use with a bulldozer, said bulldozer having a frame portion which supports a ripper tooth attached thereto and with at least one cylinder and piston mounted on said bulldozer, comprising:

hammer means; anvil means positioned adjacent the lower end of said hammer means so as to be acted upon by said hammer means during operation thereof; a gusset member secured to said anvil means and positioned adjacent to and contiguous with said ripper tooth; and at least one cylinder adapter mounted on said frame portion and having a slot therein, said cylinder and piston including a pin mounted on the end of said piston, said pin being received in the slot of said cylinder adapter, said slot having a length greater than the diameter of said pin to allow said pin to move freely back and forth in said slot.

20. The apparatus of claim 19 wherein said frame portion has a pivotal point of attachment to said bulldozer so as to pivot about said point of attachment as said pin moves up and down in said slot during operation of said bulldozer.

21. The apparatus of claim 19 wherein the length of said slot is at least 2 times the diameter of said pin.

22. Apparatus for use with a backhoe, said backhoe having a curl and having a ripper bucket attached to said backhoe, comprising:

hammer means, anvil means positioned adjacent the lower end of said hammer means so as to be acted upon by said hammer means during operation thereof, said anvil means including a longitudinal bar having a slot extending substantially parallel to the longitudinal axis of said bar, the lower end of said bar being pivotally connected to the back side of said ripper bucket; and at least one anvil guide arm connected between the curl of said backhoe and said bar, said guide arm including a pin at one end thereof with said pin being received in said slot, said slot having a length greater than the diameter of said pin to allow said pin to move freely back and forth in said slot.

23. The apparatus of claim 22 wherein said bar is pivotally connected to said hammer means.

24. The apparatus of claim 22 wherein said ripper bucket is provided with at least one ripper tooth on the exterior surface thereof.

25. The apparatus of claim 22 wherein the length of said slot is at least 2 times the diameter of said pin.

26. Apparatus for use with earth working apparatus, comprising:

hammer means; anvil means positioned adjacent the lower end of said hammer means so as to be acted upon by said hammer means during operation thereof; a ripper tooth pivotally attached to said anvil means said ripper tooth having pivot means for attachment of said ripper tooth to said earth working appartus; and with angle iron guides attached to said hammer means for use in retaining said anvil means.

27. Apparatus for use with earth working apparatus, comprising:

hammer means; anvil means positioned adjacent the lower end of said hammer means so as to be acted upon by said hammer means during operation thereof; a ripper tooth pivotally attached to said anvil means, said ripper tooth having pivot means for attachment of said ripper tooth to said earth working apparatus; and with an anvil box attached to the lower end of said hammer means for retaining said anvil means.

* * * * *